US005407406A

United States Patent [19]

Canela

[11] Patent Number: 5,407,406

[45] Date of Patent: Apr. 18, 1995

[54] EXERCISE DEVICE FOR HANDICAPPED CHILDREN

[76] Inventor: Heriberto Canela, 8027 W. 14th Ave., Hialeah, Fla. 33014

[21] Appl. No.: 77,101

[22] Filed: Jun. 16, 1993

[51] Int. Cl.[6] ..... A63B 22/00

[52] U.S. Cl. ..... 482/51; 434/255; 601/33

[58] Field of Search ..... 128/25 R, 845; 434/254, 434/255; 482/51, 56, 70; 5/622; 601/33-35

[56] References Cited

U.S. PATENT DOCUMENTS

| | | | |
|---|---|---|---|
| 219,439 | 9/1879 | Blend | 482/70 |
| 1,747,174 | 2/1930 | Knowles | 5/622 |
| 3,316,898 | 5/1967 | Brown | 482/51 |
| 3,362,090 | 1/1968 | Adam | 434/255 |
| 3,363,335 | 1/1968 | Burhns et al. | 434/255 |
| 3,460,272 | 8/1969 | Pellicore | 434/255 |
| 3,582,069 | 6/1971 | Flick et al. | 434/255 |
| 3,976,058 | 8/1976 | Tidwell | 434/255 |
| 5,224,909 | 7/1993 | Hamilton | 482/70 |

FOREIGN PATENT DOCUMENTS

| | | | |
|---|---|---|---|
| 2567022 | 1/1986 | France | 482/51 |
| 539118 | 11/1931 | Germany | 5/622 |

*Primary Examiner*—Richard J. Apley
*Assistant Examiner*—Jeanne M. Mollo
*Attorney, Agent, or Firm*—J. Sanchelima

[57] ABSTRACT

An exercise device for children with muscular impediments that permit the periodic and uniform exercising of a child's limbs. The electronic motor that drives the slidably mounted front and rear brace members can be selectively engaged or disengaged, depending on the child's needs and progress. The brace members hold the child's hands and feet and cause them to move and flex, when forced over a predetermined path defined by front and rear channel assemblies. The mechanism can be selectively engaged and disengaged depending on the needs of the child. Telescopic linkage arms are provided to adjust the extent to which the child's limbs will be moved. A canvas and a mask keep the child horizontally suspended while being exercised.

2 Claims, 4 Drawing Sheets

EXERCISE DEVICE FOR HANDICAPPED CHILDREN

BACKGROUND OF THE INVENTION

1. Field of the Invention

The present invention relates to therapeutic devices, and more particularly, to such devices that exercise the muscles of children that suffer from cerebral paralysis.

2. Description of the Related Art

To this date, there are no devices to mechanically exercise the muscles of children suffering from cerebral paralysis. The therapy for these patients is done manually with the consequent personnel requirement which is typically expensive.

SUMMARY OF THE INVENTION

It is one of the main objects of the present invention to provide a device that can automatically exercise a child with cerebral paralysis and be selectively disconnected from its motor driven assembly when the child starts generating its own movements.

It is another object of this present invention to provide a device that is capable of exercising all of the child's muscles.

It is still another object of this present invention to provide such a device that can be adjusted as the child grows or improves so that the movement of the child's limbs and body can be extended or changed.

It is yet another object of this present: invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
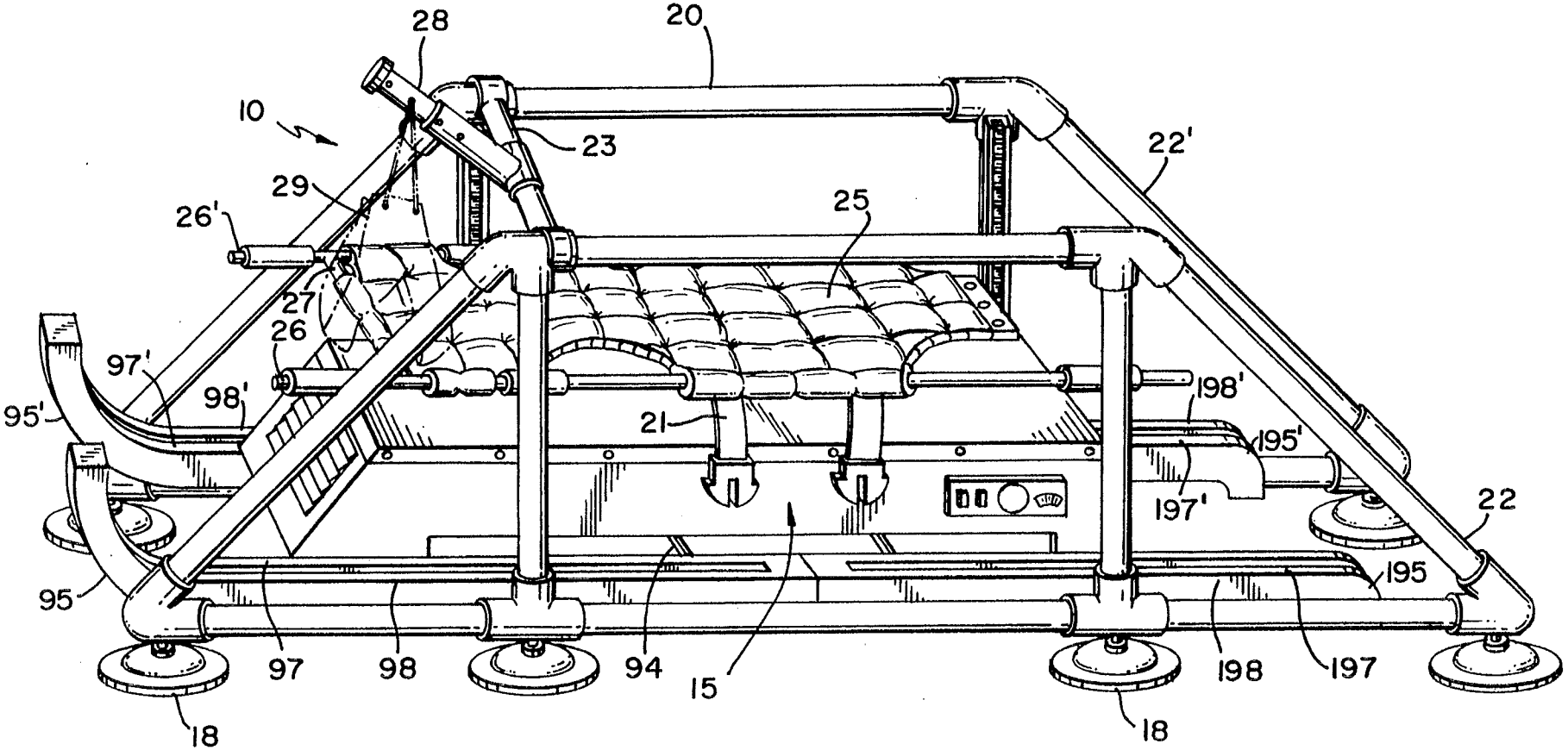
FIG. 1 represents an isometric view of the device.

Referring now to the drawings, where the present invention is generally referred to with numeral 10, it can be observed that it basically includes housing 15 wherein different mechanical and electrical components are housed. Frame structure 20 includes the structural members required to keep the child suspended over housing 15. Frame structure 20 includes side structural assemblies 22 and 22' composed of several interconnected rigid structural members. Assemblies 22 and 22' are kept in a spaced apart relationship to each other by upper transversal member 23. Adjusting pads 18 help maintain device 10 leveled.

Figure 2:
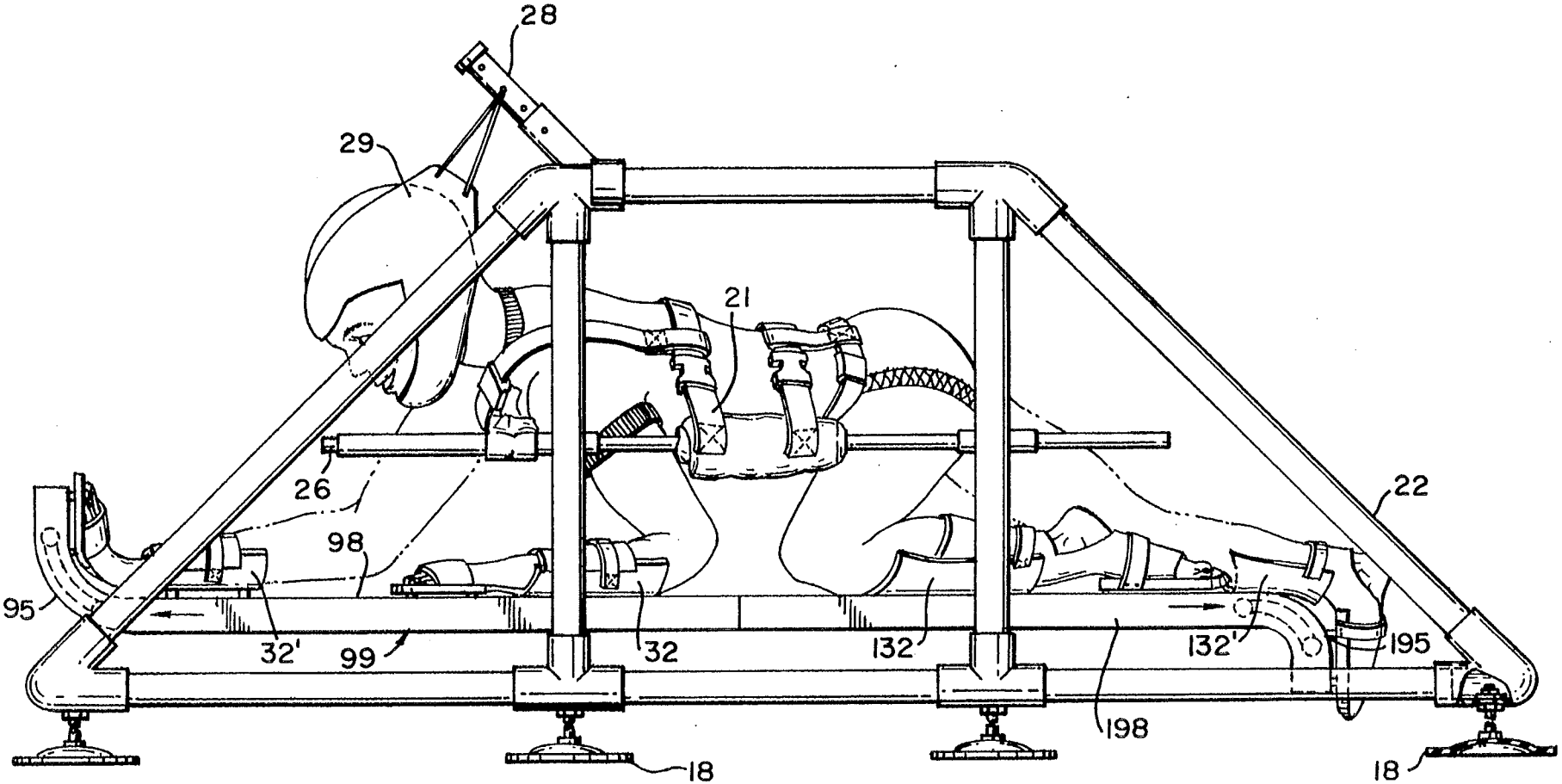
FIG. 2 is a side elevational view of the device showing a child using it.

Elongated members 26 and 26' are connected to each other by transversal member 27 with supporting canvas 25 designed to keep the child suspended over housing 15 while his limbs are exercised by the mechanism described below. As shown in FIG. 2, several straps 21 ensure that the child does not roll off supporting canvas 25. Telescopic member 28 extends upwardly from upper transversal member 23 and holds head support mask 29 intended to keep the child's head substantially at the same level as the rest of the body.

Figure 3:
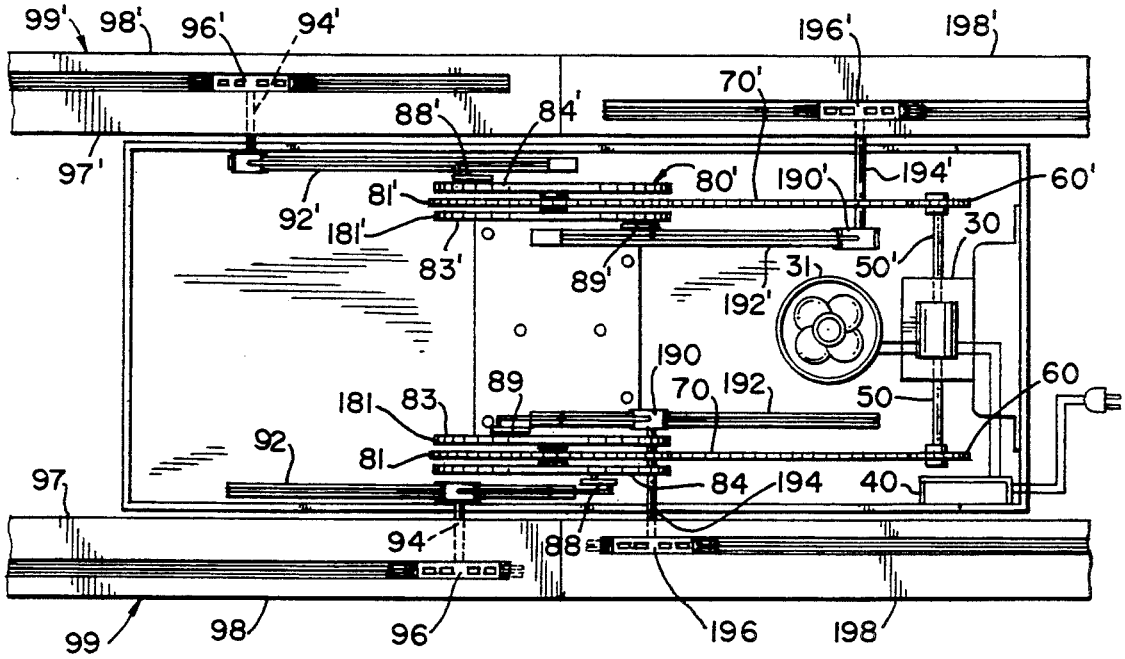
FIG. 3 illustrates a top view of the device.

In the preferred embodiment, as best seen in FIG. 3, electric motor assembly 30 and timer switch assembly 40 are connected and fed by a conventional AC voltage source of 110 volts. Exhaust fan 31 is used to keep the temperature low inside housing 15. Motor assembly 30 causes axles 50 and 50' to rotate driving sprocket members 60 and 60' which are rigidly mounted to the ends of axles 50 and 50'. Chain members 70 and 70' are trained over driving sprocket members 60 and 60', respectively, and over driven sprocket member 81 and 81' of driven sprocket assemblies 80 and 80', respectively.

Figure 4:
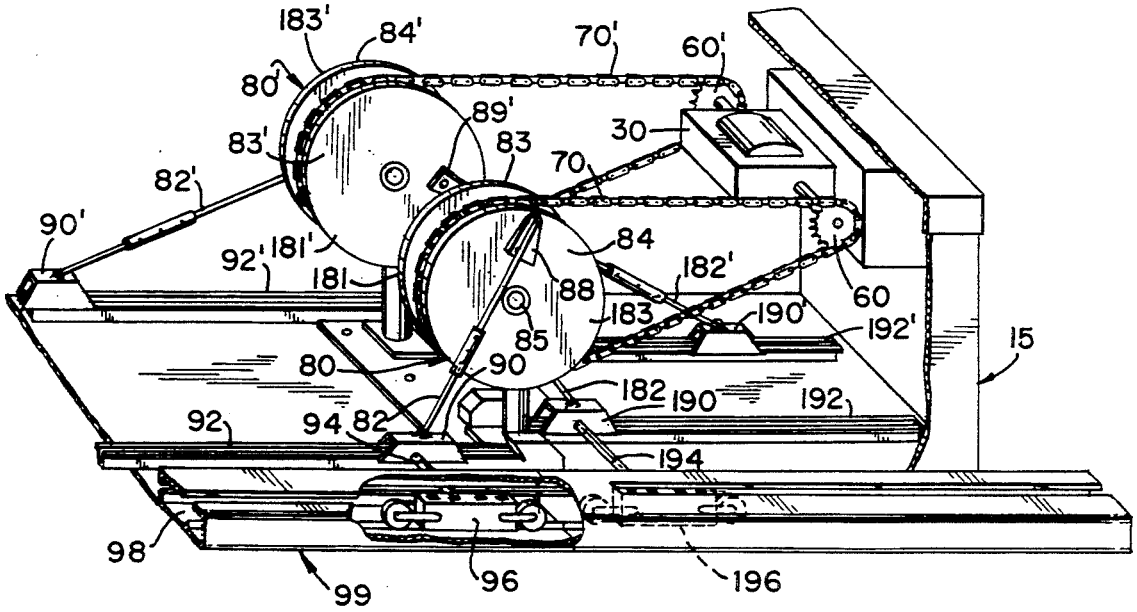
FIG. 4 is a partial isometric representation of the device.
Figure 7:
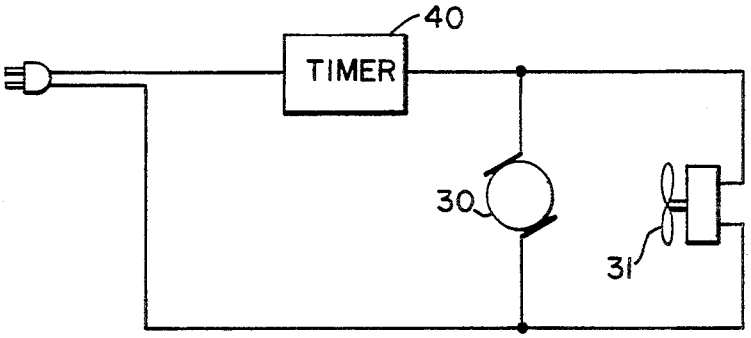
FIG. 7 is an electrical diagram for the motor and fan circuit that is selectively controlled by the timer.
Figure 6:
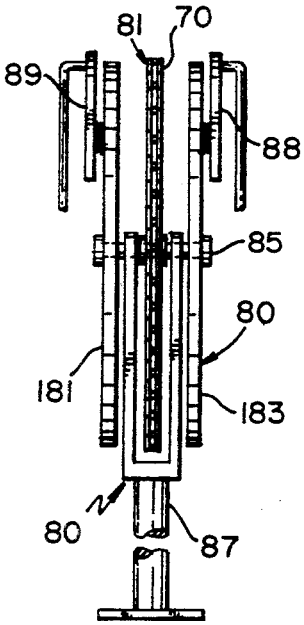
FIG. 6 is a detailed view of the driven sprocket.
Figure 5:
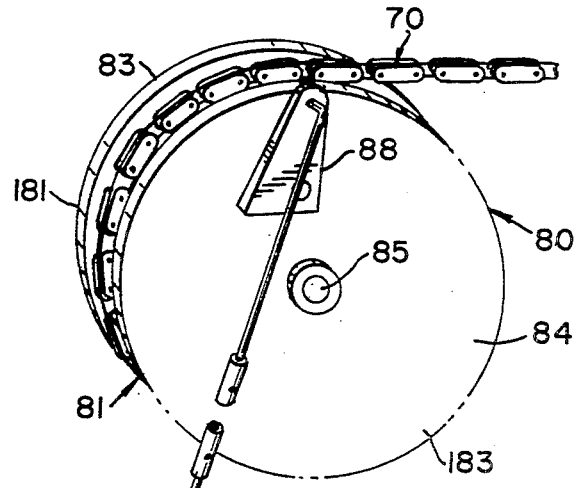
FIG. 5 is a partial enlarged view of the driven sprocket.
Figure 5:
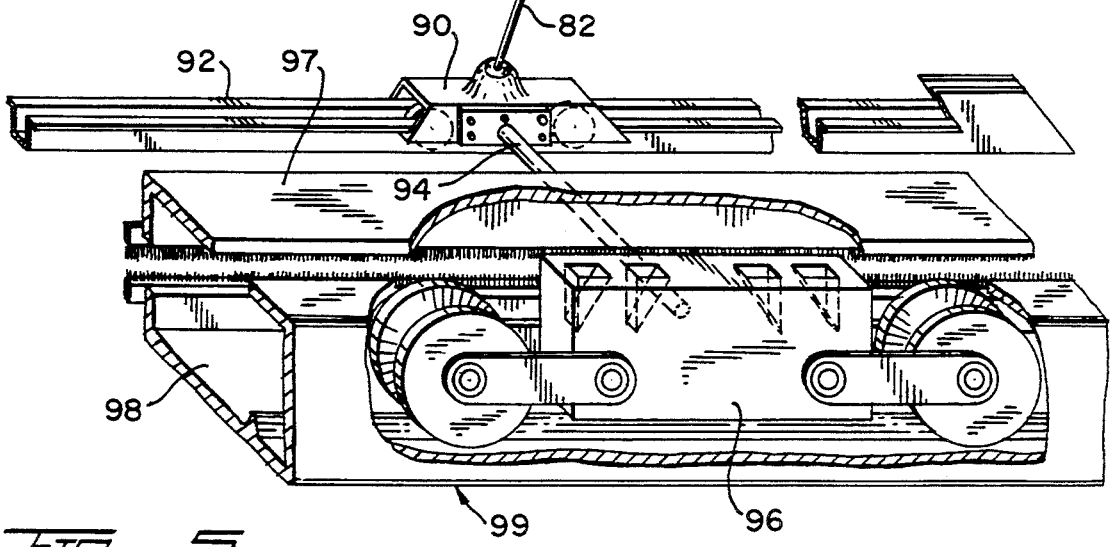

Driven sprocket assembly 80 (and 80') is best seen in FIG. 6, and it includes driven sprocket member 81 and inner and outer disks 181 and 183 that are rigidly mounted to shaft 85 to which driven sprocket member is also rigidly mounted. Supporting bearing member 87 provides the support for shaft 85. Pivoting arms 88 and 88' are pivotally mounted to the outer surfaces 84 and 84' of disks 183 and 183' as best seen in FIGS. 3 and 4. Similarly, pivoting arms 89 and 89' are pivotally mounted to outer surfaces 83 and 83' of disks 181 and 181', respectively.

Front linkage members 82 and 82' are, at one end, pivotally mounted to pivoting arms 88 and 88' of driven sprocket assemblies 80 and 80', respectively as best seen in FIGS. 3 and 4. The other ends of adjustable front linkage members 82 and 82' are pivotally mounted to front moving shoe assemblies 90 and 90' that are slidably mounted to front rail guide members 92 and 92'. Connecting rods 94 and 94' are removably connected to front carriers 96 and 96' which slidably travel within front channel assemblies 98 and 98' within base tubular members 99 and 99' . Similarly, rear linkage members 182 and 182' are, at one end, pivotally mounted to outer surfaces 83 and 83' of disks 181 and 181' in driven sprocket assemblies 80 and 80' . The other ends of rear linkage members 182 and 182' are pivotally mounted to rear moving shoe assemblies 190 and 190' that are in turn slidably mounted to front rail guide members 192 and 192' . Connecting rods 194 and 194' are removably connected to rear carriers 196 and 196' which slidably travel within rear channels 198 and 198' .

The reason for making connecting rods 94; 94'; 194 and 194' removably connected to front and rear carriers 96; 96'; 196 and 196' is to permit a child, as he or she progresses, to exercise on his own one or more of his/her limbs when the force from the electric motor is not required.

Front brace assemblies 32 and 32' are rigidly mounted to the upper part of front carriers 96 and 96'. Assemblies 32 and 32' cooperatively receive the child's hands and arms and are adapted to follow the contour of upper surfaces 97 and 97' of channel assemblies 98 and 98'. Likewise, there are rear brace assemblies 132 and 132' are designed to cooperatively receive the child's feet and force them to follow a predetermined distance over upper surface 197 and 197'. Channel assemblies 98; 98'; 198 and 198' include bent ends 95; 95'; 195 and 195' designed to cause the child's hands and feet to flex in predetermined angles at the end of the trajectory.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An exercise device for a child with muscular impediments who require assistance in exercising their limbs, comprising:

A. support structure means having two longitudinally and upwardly extending assemblies in spaced apart parallel relationship with respect to each other;

B. means for suspending the child horizontally, face down, including means for holding the head substantially at the same level as the rest of the body and said means for supporting said child connected to said upwardly extending assemblies;

C. front brace means for receiving the child's hands;

D. rear brace means for receiving the child's feet;

E. means for longitudinally guiding said front and rear brace means so that said front brace means and said rear brace means are slidably mounted over said means for guiding and adapted to cause the child's arms and legs to move resembling a crawl in response to the movement of said front and rear brace means; and F. means for selectively providing reciprocal movement to said front and rear brace means along said means for guiding including means for adjusting the length of the travel of said front and rear brace means along said guiding means and further including electric motor means to impart said reciprocal movement and said means for releasably providing reciprocal movement being removably connected to said front and rear brace means so that the child may continue to advance on his/her exercise therapy on his/her own and further including a driving sprocket driven by said electric motor means and a driven sprocket actuated by said driving sprocket and further including a chain member trained over said driving and driven sprockets and said means for adjusting the length of the travel of said front and rear brace means along said guiding means includes adjustable linkage means pivotally connected to said driven sprocket and rear brace means.

2. The device set forth in claim 1 wherein said means for longitudinally guiding said front and rear brace means includes a path that causes the child's hands and feet to flex a predetermined angle.

* * * * *